US008298681B2

(12) United States Patent
Aydin et al.

(10) Patent No.: US 8,298,681 B2
(45) Date of Patent: Oct. 30, 2012

(54) EXTRUSION BILLET

(75) Inventors: Ali Aydin, Voehringen (DE); Hans-Peter Hoehe, Westerstetten (DE); Leszek Poletek, Ulm (DE); Florian Schopper, Westerstetten (DE)

(73) Assignee: Wieland-Werke AG, Ulm (DE)

( * ) Notice: Subject to any disclaimer, the term of this patent is extended or adjusted under 35 U.S.C. 154(b) by 638 days.

(21) Appl. No.: 11/825,749

(22) Filed: Jul. 9, 2007

(65) Prior Publication Data

US 2008/0075969 A1 Mar. 27, 2008

(30) Foreign Application Priority Data

Sep. 26, 2006 (DE) ..... 10 2006 045 234

(51) Int. Cl.
*B21C 37/00* (2006.01)
*B22D 7/00* (2006.01)

(52) U.S. Cl. ..... 428/577; 428/582; 428/583

(58) Field of Classification Search ..... 428/577, 428/582, 583, 584, 585
See application file for complete search history.

(56) References Cited

U.S. PATENT DOCUMENTS

| | | | | | |
|---|---|---|---|---|---|
| 1,599,572 | A | | 9/1926 | Lusher | |
| 1,720,722 | A | | 7/1929 | Dean | |
| 3,766,768 | A | * | 10/1973 | Fuchs et al. | 72/256 |
| 3,805,574 | A | | 4/1974 | Wessel | |
| 4,677,838 | A | | 7/1987 | Bessey et al. | |
| 5,016,460 | A | * | 5/1991 | England et al. | 72/208 |
| 5,309,748 | A | * | 5/1994 | Jarrett et al. | 72/256 |
| 5,413,650 | A | * | 5/1995 | Jarrett et al. | 148/690 |
| 5,475,915 | A | * | 12/1995 | Valaris | 29/599 |
| 6,470,726 | B1 | * | 10/2002 | Murata et al. | 72/260 |
| 2004/0219050 | A1 | * | 11/2004 | Hailey | 419/28 |
| 2007/0107201 | A1 | * | 5/2007 | Erike | 29/525.14 |

FOREIGN PATENT DOCUMENTS

| | | | |
|---|---|---|---|
| DE | 728 857 | | 12/1942 |
| DE | 30 17 535 | C2 | 11/1981 |
| DE | 100 24 459 | A1 | 11/2001 |
| EP | 0 727 262 | B1 | 8/1996 |
| GB | 625 919 | | 7/1949 |
| JP | 57 22814 | | 2/1982 |
| JP | 58-67819 | | 4/1983 |
| JP | 58-217633 | | 12/1983 |
| JP | 3-198911 | | 8/1991 |
| WO | WO 96/11757 | * | 4/1996 |

OTHER PUBLICATIONS

European Patent Office Search Report dated Jan. 7, 2008 (8 pages).

* cited by examiner

*Primary Examiner* — Michael La Villa
(74) *Attorney, Agent, or Firm* — Flynn, Thiel, Boutell & Tanis, P.C.

(57) ABSTRACT

The invention relates to an extrusion billet having two end sides, characterized in that the surface of at least one end side face has a three-dimensional topography which is composed of a substantially planar end side face from which local elevations protrude.

4 Claims, 2 Drawing Sheets

EXTRUSION BILLET

FIELD OF THE INVENTION

The present invention relates to an extrusion billet and to a method for heating extrusion billets in a pusher-type furnace.

DESCRIPTION OF THE PRIOR ART

Different furnace systems are used to heat, for example, copper billets. A decisive factor for the efficiency of the plant is the most complete utilization possible of the energy for heating the blocks. The extent to which this demand can be realized is dependent inter alia on how great the heat losses of the furnace are and how efficiently the flue gas enthalpy can be utilized for the block heating.

One method which is advantageous from an economic point of view is the use of a block heating system which is designed according to the pusher-type furnace principle. As a result of the material transport mechanism used here, the furnace casing can be designed so as to be closed in a gas-tight manner, which leads to minimum heat losses of the furnace. In addition, the highest possible efficiency is obtained by means of 3-stage heat reclamation, in the form of a convection preheating path, combustion air preheating and subsequent utilization of the condensation heat of water vapor in the furnace entry region.

A serious disadvantage of heating copper billets or copper alloy billets with high copper content using a pusher-type furnace is that, at high material temperatures of up to 960-980° C. and with the high pressures which act on the billet end sides, the billets are partially welded solidly to one another. Said welds can be explained by diffusion processes which occur at the billet contact points and cause a cohesive connection.

Presently-used methods for avoiding said welds are for example an application of coating, a spacer or the oxidation of the billet end sides.

For example, document EP 0 727 262 B1 discloses a device for sooting extrusion billets in order to generate a separating layer between an extrusion billet and a ram. For this purpose, acetylene via a nozzle with a high outlet speed is burned with a targeted oxygen supply such that a soot layer is formed on the end side of the extrusion billet.

Furthermore, DE 30 17 535 C2 discloses a method for heating blocks in a pusher-type furnace, in which method, at the exit-side end of the furnace, the blocks are pushed over a tipping edge in order to separate the blocks from one another and to generate a sufficient spacing between the blocks for further transport.

In addition, DE 100 24 459 A1 discloses a method for heating rolling stock in a pusher-type furnace, in which method spacers are placed between the individual rolling stock parts.

All of these methods have the disadvantage that, on the one hand, it is not possible to achieve a sufficient degree of process reliability with regard to the avoidance of welds, or on the other hand, foreign materials are applied to the billets, which are later found as residues in the pressed product. Accordingly, it is then not possible to prevent a spread of undesired materials into the recycling circuit.

Against this background, it is the object of the invention to refine extrusion billets such that they can be easily separated from one another during a temperature treatment in a pusher-type furnace.

SUMMARY OF THE INVENTION

The invention is expressed, with regard to an extrusion billet and with regard to a method for heating extrusion billets in a pusher-type furnace and further advantageous embodiments and refinements of the invention.

The invention encompasses an extrusion billet having two end side faces, with the surface of at least one end side face having a three-dimensional topography which is composed of a substantially planar end side face from which local elevations protrude.

Here, the invention proceeds from the consideration of generating a defined contact face between the billets in order to obtain a targeted adhesive bond if this is unavoidable on account of high process temperatures. In pusher-type furnaces, the billets lie tightly adjacent to one another in the form of a strand. Every new admission at the entry-side end of the furnace results in the contents of the furnace being transported one step further. A heated billet passes out of the furnace at the exit-side end as a result. The contact face is dimensioned such that, when a billet is dispensed at the end of a pusher-type furnace, a simple set of tongs is sufficient to reliably separate a surface, which has welded to an adjacent billet, with comparatively little force expenditure. Here, the required contact face can be determined already from material characteristic variables by means of calculative methods for cold and hot shaping.

The particular advantage is that the common contact face with adjacent billets is correspondingly minimized in order that they can be easily separated from one another after a temperature treatment in a pusher-type furnace.

In one preferred embodiment of the invention, a pin, a plate or a spherical-cap-shaped convexity can be arranged as a local elevation. Here, it is possible in particular for the pins to have such a small diameter that they can by all means be deformed in a pusher-type furnace by the transport process, but remain resistant to buckling. The deformation can however be accepted only to such an extent that no large-area contact of adjacent billet surfaces occurs.

In one preferred refinement, a pin, a plate or a spherical-cap-shaped convexity can be arranged centrally. In this way, for the transport mechanism in a pusher-type furnace, a central force is generated on adjacent extrusion billets in the axial direction.

It is also preferable for a plurality of pins, plates or spherical-cap-shaped convexities to be arranged so as to be distributed over the end side face. In this way, the force responsible for the transport in a pusher-type furnace is distributed uniformly on a plurality of local elevations in order to counteract deformation.

The pins, plates or spherical-cap-shaped convexities can preferably be made from the same material as the extrusion billet, for example from copper or a copper alloy. This primarily ensures that no foreign materials are placed in connection with the billets, which foreign materials could be later found as residues in the pressed product. Accordingly, it is then possible to prevent a spread of undesired materials into the recycling circuit.

Further advantages emerge if the pins, plates or spherical-cap-shaped convexities are attached by means of a welded connection. Such connections are simple to produce and ensure a reliable cohesive connection to the billet or block material.

The pins can advantageously in each case be arranged in bores. Here, the pins can also be fastened to the billet by means of a riveting process. In this way, no foreign materials are used during joining.

The respective end side face can advantageously have convexities on the outer periphery. Said convexities can be generated by means of non-cutting shaping processes by means of radial upsetting or hammering.

In a further preferred embodiment of the invention, the respective end side face can have an annular bead on the outer periphery. This can be provided by means of rolling of the billet edge in the transition of the end side to the end side face. The end sides can also be correspondingly shaped by means of other shaping methods such as for example backward extrusion.

A further aspect of the invention encompasses a method for heating extrusion billets in a pusher-type furnace, wherein at least one end side face, which comes into contact with an adjacent extrusion billet, has a three-dimensional topography which is composed of a substantially planar end side face from which local elevations protrude, with the common contact face being so small that, in the case of a cohesive connection being generated by the heating, the extrusion billet which emerges at the exit-side end of the furnace can, with little force expenditure, be separated from the adherent adjacent extrusion billet by means of a separating device or even by means of its own weight.

The advantages obtained by means of the invention are the simple separation of the billets transported in a pusher-type furnace as a result of a reduction of the common contact faces.

BRIEF DESCRIPTION OF THE DRAWINGS

Further advantages and embodiments of the invention are explained in more detail on the basis of the schematic drawings, in which.

DETAILED DESCRIPTION OF THE INVENTION

Corresponding parts are provided with the same reference symbols in all of the figures.

Figure 1:
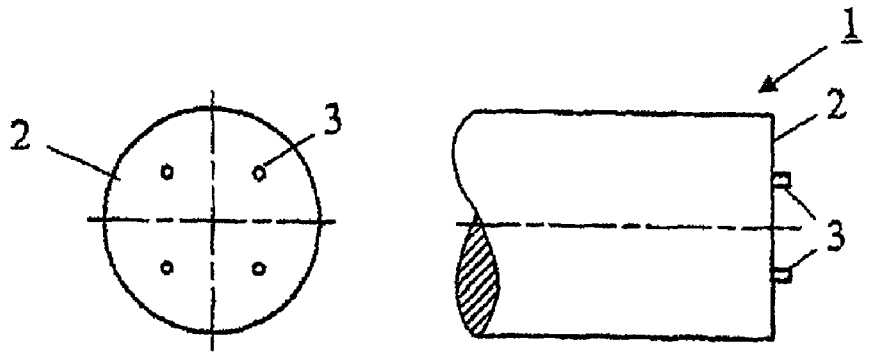
FIG. 1 shows a side view, and the corresponding front view, of a billet with four pins arranged on the end side face.

FIG. 1 shows a side view, and the corresponding front view, of an extrusion billet 1 with four pins 3 arranged on the end side face 2 as an embodiment of the invention in which additional material is used. Small pins 3, made from the same material as the billet 1 for recycling reasons, are attached so as to be distributed on the end side face of the billet 1. The size of the overall area of all of the pins 3 is fixed by the tearing force when extracting the billet 1.

Figure 2:
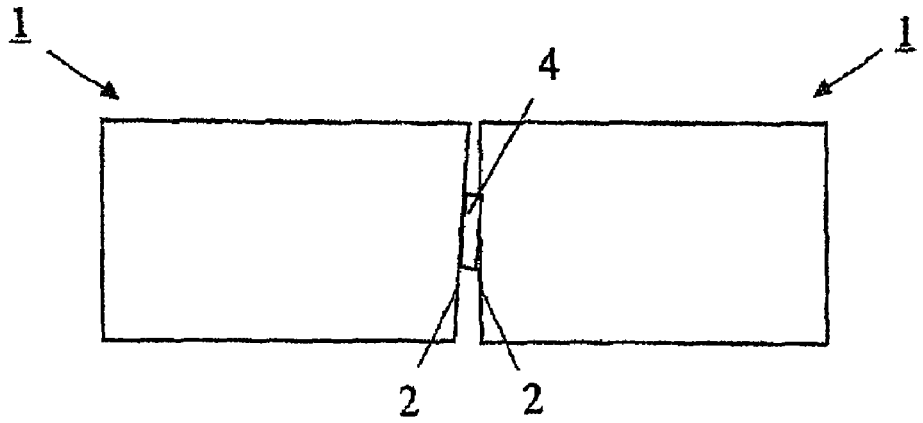
FIG. 2 shows a side view of two billets which are in contact with a central arrangement of a plate with a slightly beveled section.

FIG. 2 shows a side view of two billets 1, which are in contact, with a central arrangement of a plate 4 on the end side face 2 of the billet 1, with a slightly beveled section. The plate 4 can for example be punched from a material strip. Its thickness must be at least great enough that, even with a lightly beveled section, the billet and adjacent billet come into contact with one another only in the region of the plate 4. The size of the area is in turn fixed by the tearing force when extracting the billet 1. The pins 3 and plate 4 can then, for example, be joined on to the billet for example by means of welding, adhesive bonding or riveting.

Figure 3:
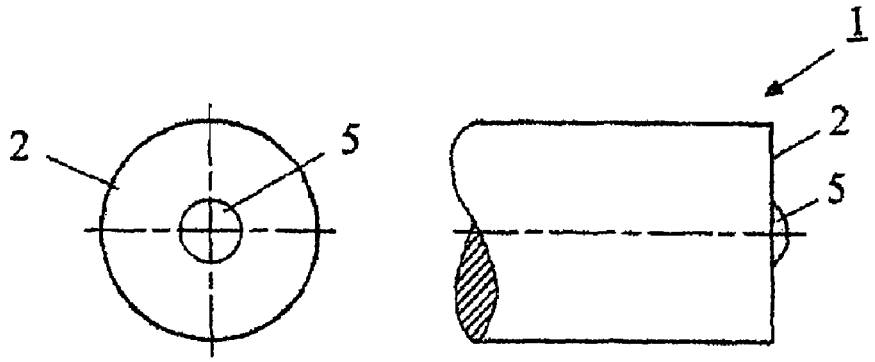
FIG. 3 shows a side view, and the corresponding front view, of a billet with a centrally arranged spherical cap.

FIG. 3 shows a side view, and the corresponding front view, of a billet 1 with a centrally arranged spherical-cap-shaped convexity 5.

Figure 4:
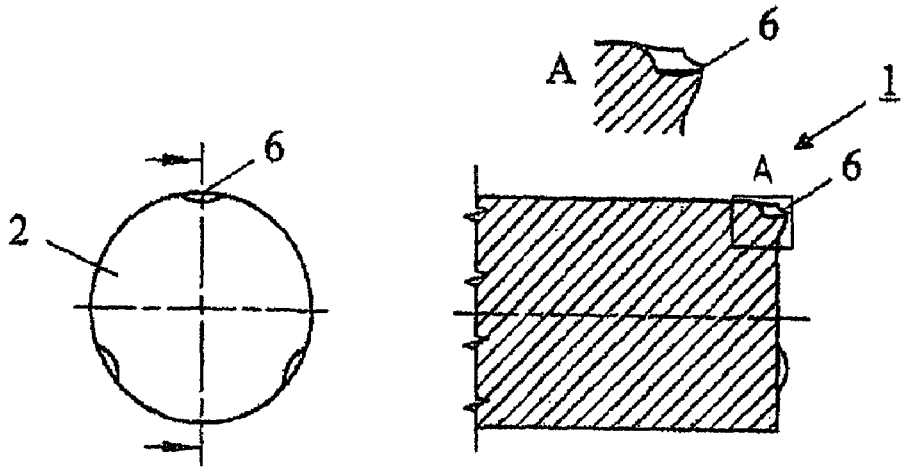
FIG. 4 shows a longitudinal section, and the corresponding front view, of a billet with convexities on the outer periphery.

FIG. 4 illustrates a further example in which no additional material is required. The aim in principle is to obtain elevations according to the invention on the end side face of the billet 1. The figure shows a longitudinal section, and the corresponding front view, of a billet 1 with convexities on the outer periphery 6. In order to produce the convexity 6, a punch is pressed radially into the billet material in the region of the peripheral edge of the billet. Depending on the possibilities of the axial support of the billet 1, the edge can be broken. The displaced material flows in the direction of least resistance and thereby forms a bulge on the free end side 2. Some further locally arranged bulges can be distributed over the periphery. The detail A shows an enlarged illustration of a convexity 6.

Figure 5:
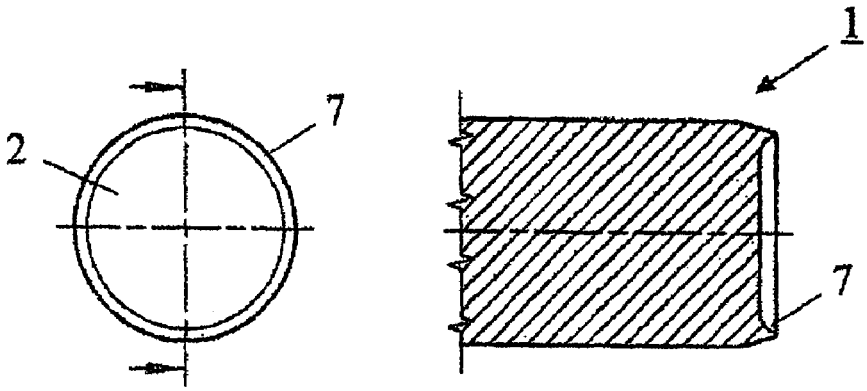
FIG. 5 shows a longitudinal section, and the corresponding front view, of a billet with an annular bead.

FIG. 5 shows a longitudinal section, and the corresponding front view, of a billet 1 with an annular bead 7. The bead 7 is generated by rolling of the billet edge in the transition of the end side to the side face.

Figure 6:
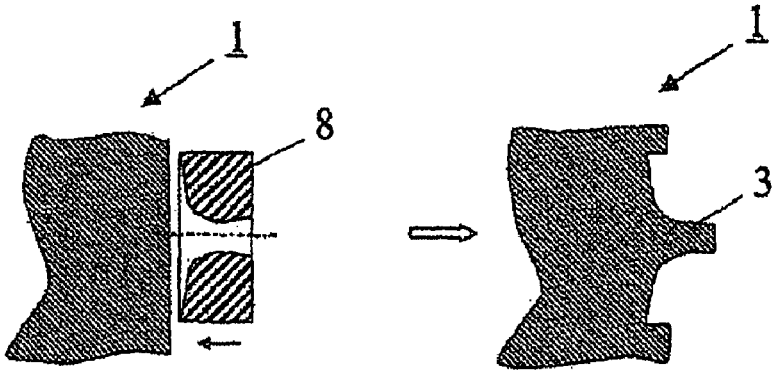
FIG. 6 shows a detail of a billet shaped by means of backward extrusion, before and after shaping.

FIG. 6 shows a detail of a billet 1 shaped by means of backward extrusion, before and after shaping by means of a pressing tool 8. The material flows counter to the direction of action of the tool movement. By means of end-side upsetting of the billet 1 using a tool, the billet material is caused to flow. The tool 8 must be constructed such that it has cutouts for the pin-shaped convexities 3. If the flow resistance in the other spatial directions is too great, the material will flow through the cutouts counter to the tool movement. If appropriate, the billet 1 must be correspondingly supported.

LIST OF REFERENCE SYMBOLS

1 Extrusion billet
2 End side
3 Pins
4 Plate
5 Spherical-cap-shaped convexities
6 Convexities on the outer periphery
7 Annular bead
8 Pressing tool

The invention claimed is:

1. A metallic extrusion billet having end side faces provided at opposite ends thereof, characterized in that at least one end side face has a three-dimensional topography composed of a substantially planar surface from which local elevations made from the same material as the extrusion billet protrude therefrom, whereby a plurality of pins, plates or spherical cap-shaped convexities are provided on the substantially planar surface.

2. The extrusion billet of Claim 1, characterized in that a pin, a plate or a spherical cap-shaped convexity is provided as a local elevation.

3. The extrusion billet of claim 2, characterized in that the pin, plate or spherical cap-shaped convexity is provided at a central position on the substantially planar surface.

4. The extrusion billet of claim 2, characterized in that the pin, plate or spherical cap-shaped convexity is welded to the substantially planar surface.

* * * * *